US006520381B1

(12) United States Patent
Prestele

(10) Patent No.: US 6,520,381 B1
(45) Date of Patent: Feb. 18, 2003

(54) EJECTION DEVICE FOR A CARTRIDGE

(75) Inventor: Eugen Prestele, Augsburg (DE)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/869,621

(22) PCT Filed: Dec. 23, 1999

(86) PCT No.: PCT/EP99/10360

§ 371 (c)(1),
(2), (4) Date: Jun. 28, 2001

(87) PCT Pub. No.: WO00/40341

PCT Pub. Date: Jul. 13, 2000

(30) Foreign Application Priority Data

Dec. 30, 1998 (DE) ..... 298 23 237 U

(51) Int. Cl.[7] ..... B67D 5/52
(52) U.S. Cl. ..... 222/137; 222/390
(58) Field of Search ..... 222/137, 390, 222/145.1, 327

(56) References Cited

U.S. PATENT DOCUMENTS 2,826,339 A * 3/1958 Maillard ..... 222/137
5,104,005 A * 4/1992 Schneider, Jr. et al. ..... 222/137
5,207,357 A * 5/1993 Aronie et al. ..... 222/390
5,566,860 A * 10/1996 Schlitz et al. ..... 222/390

* cited by examiner

*Primary Examiner*—Philippe Derakshani
(74) *Attorney, Agent, or Firm*—Flynn, Thiel, Boutell & Tanis, P.C.

(57) ABSTRACT

The invention relates to an ejection device for a cartridge which comprises two chambers (1, 2) arranged concentrically to one another. Each chamber (1, 2) is provided with a piston (4, 5). The ejection device also comprises ejection rods which can be shifted in the direction of the outlet (3) of the cartridge. A cap (6) is provided which can be axially locked with the cartridge. The ejection rods are guided through said cap (6). The external ends of the ejection rods for the annular piston (5) are connected to one another via a cover plate (11). A threaded spindle (9) is supported at the cover plate (11). Said threaded spindle (9) extends through a threaded tapped hole (8) of the cap (6) and serves as an ejection rod for the middle piston (4).

13 Claims, 3 Drawing Sheets

EJECTION DEVICE FOR A CARTRIDGE

FIELD OF THE INVENTION

The invention relates to an ejection device for emptying a cartridge according to the preamble of claim 1.

BACKGROUND

To empty 1-component cartridges it is known to mount a cap on the backside of the cartridge, which cap is locked in the axial direction. This cap has centrally a tapped hole, through which extends a threaded spindle. The threaded spindle has at one end an abutment which rests on the backside of t he piston and is movable in the cartridge. The threaded spindle has at the other end a winglike handle. By rotating the spindle, it moves into the inside of the cartridge and hereby moves the piston causing the material inside of the cartridge to exit through the cartridge outlet opening. This ejection device, however, is only suited for cartridges with one single chamber.

Otherwise cartridges are also known which contain two components which are provided in chambers arranged concentrically to one another. Each of the chambers are closed off on their back sides by a piston, whereby the piston for the outer chamber is an annular piston.

Ejection pistons are used to empty such cartridges, which pistons each have one abutment. Such ejection pistons are relatively expensive. However, it is also possible to empty such cartridges using an ejection slide, which is sleeve-shaped with a center rod. The sleeve wall comes hereby into contact with the annular piston, whereas the center rod comes into contact with the piston of the inner chamber. The center rod and the sleeve wall are connected with one another by a bottom piece. By placing the bottom piece onto a base and by pressing the cartridge into the ejection slide it is possible to empty the cartridge content.

This ejection device, which requires only one ejection slide, is relatively inexpensive, however, it is extremely difficult to handle.

The purpose of this invention is to provide an ejection device for a cartridge containing at least two components in such a manner that the cartridge can be emptied in a simple manner, in particular, that the mixer that is mounted on the cartridge can be attached during the emptying where the material of the cartridge is supposed to be applied.

This purpose is attained with the characteristics of claim 1. Advantageous developments can be taken from the subclaims.

BRIEF DESCRIPTION OF DRAWINGS

One exemplary embodiment will be discussed in greater detail hereinafter in connection with the drawings, in which.

DETAILED DESCRIPTION

Figure 1:
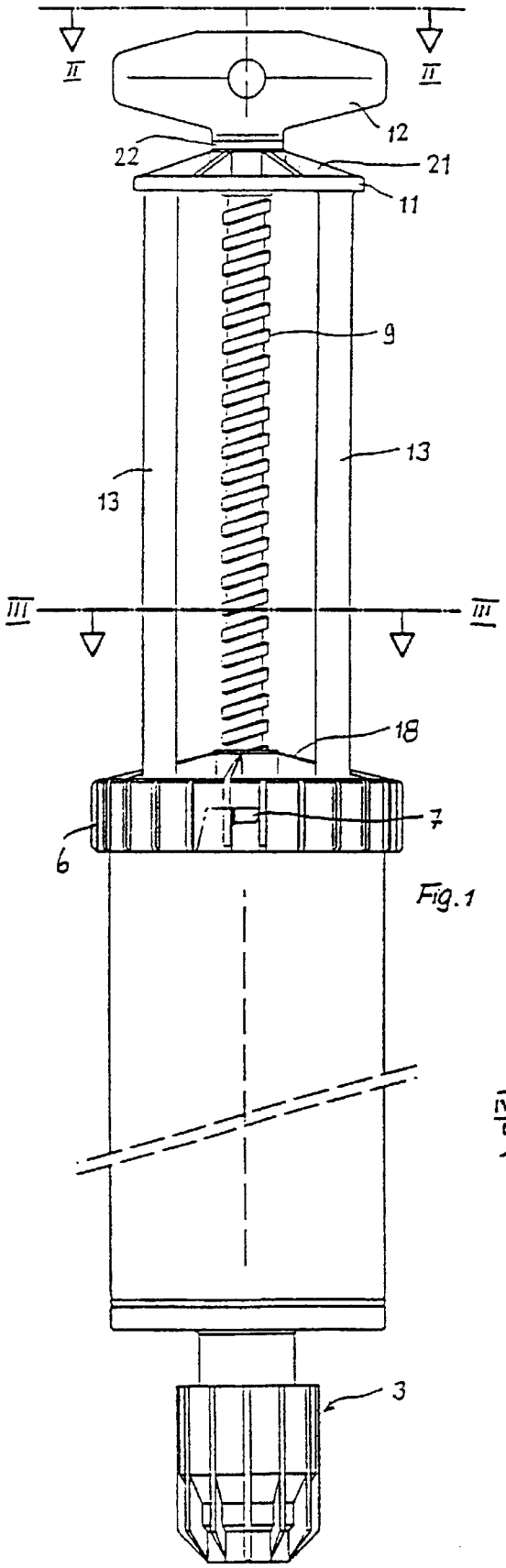
FIG. 1 is a side view of the cartridge with ejection device.
Figure 2:
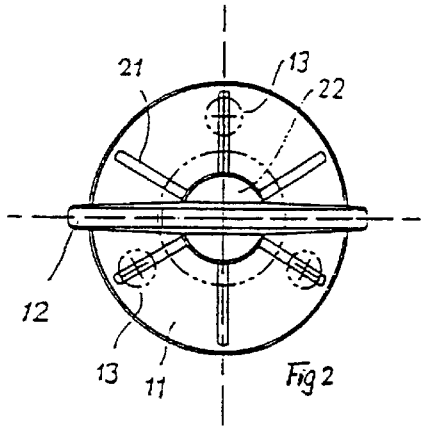
FIG. 2 is a top view in direction of the arrows II—II.
Figure 3:
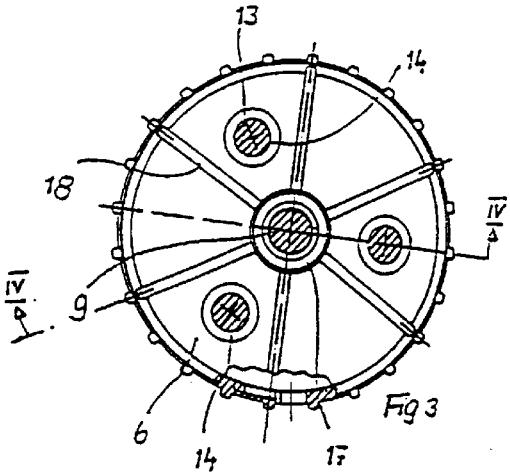
FIG. 3 is a cross-sectional view taken along the line III—III of FIG. 1.
Figure 4:
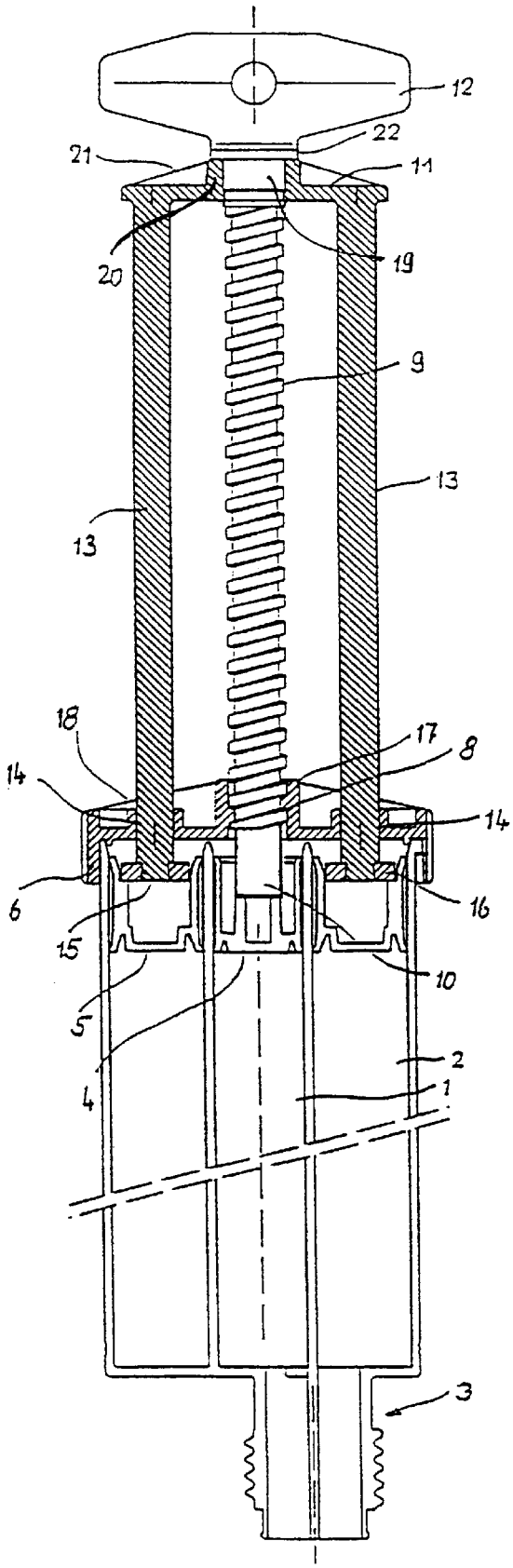
FIG. 4 is a cross-sectional view taken along the line IV—IV of FIG. 3.

The cartridge illustrated in FIGS. 1 and 4 is a cartridge having two components with an inner chamber 1 and an outer chamber 2 concentric to the inner chamber. Both chambers 1, 2 open into a cartridge outlet opening 3.

The chamber 1 is closed off on the back side by a piston 4 having a circular cross section, whereas the chamber 2 is closed off by an annular piston 5.

The volumes of the chambers 1, 2 correspond with the mixing ratio of the two components contained in the chambers 1, 2. This means that the ejection device must move the pistons 4, 5 the same distance in the direction of the outlet opening 3.

The ejection device has a cap 6, which is connected to the backside of the cartridge via bayonet locks 7. The bayonet locks serve as an axial lock for the cap 6, which is thus connected nonmovably in axial direction to the backside of the cartridge. The axial lock of the cap 6 on the backside of the cartridge can also be accomplished by a thread engagement between the cap 6 and the cartridge.

The cap 6 has a center tapped hole 8, the thread of which engages the thread of a threaded spindle 9. The threaded spindle 9 has a cylindrical shoulder 10 to form an abutment that rests against the piston 4.

The part of the threaded spindle 9 that projects from the cap 6 is rotatably supported in a cover plate 11 and terminates in a winglike handle 12 oriented above the cover plate 11.

Three pressure rods 13 are provided as a portion of the cover plate 11. The pressure rods are arranged at a radial distance with respect to the spindle 9 and offset at 120° to one another. These pressure rods 13 extend from the cover plate 11 parallel with respect to the threaded spindle 9 in the direction of the cap 6 and are guided through bores 14 through the cap 6 into the inside of the cartridge. An annular abutment 16, which rests against the annular piston 5, is secured through bores 15 to the ends of the pressure rods 13 on the side of the cartridge.

FIGS. 1 and 4 illustrate the initial position of the ejection device with a filled cartridge and with a cartridge to be emptied.

After the cap 6 has been secured through the bayonet locks 7 to the backside of the cartridge, the threaded spindle 9 is rotated by the handle 12, which threaded spindle 9 is screwed into the inside of the cartridge due to the thread of the tapped hole 8. This piston 4 is moved in the direction of the cartridge outlet opening 3 by the abutment 10 resting on the backside of the piston 4. Since an axial movement of the threaded spindle 9 is also carried out by the cover plate 11, the pressure rods 13 are also moved in the direction of the cartridge synchronously with the threaded spindle 9. The abutment 16 thus moves the piston 5 synchronously with the piston 4.

The tapped hole 8 is arranged in a sleeve 17 provided on and projecting above the plane of the cap 6. Support ribs 18 extend from the edge of the cap 6 to the sleeve 7.

The bore supporting the cylindrical shoulder 19 of the threaded spindle 9 is also arranged in a sleeve 20, toward which extend support ribs 21 from the edge of the cover plate 11. The threaded spindle 9 is supported by a shoulder 22 on the outside of the sleeve 20.

Figure 6:
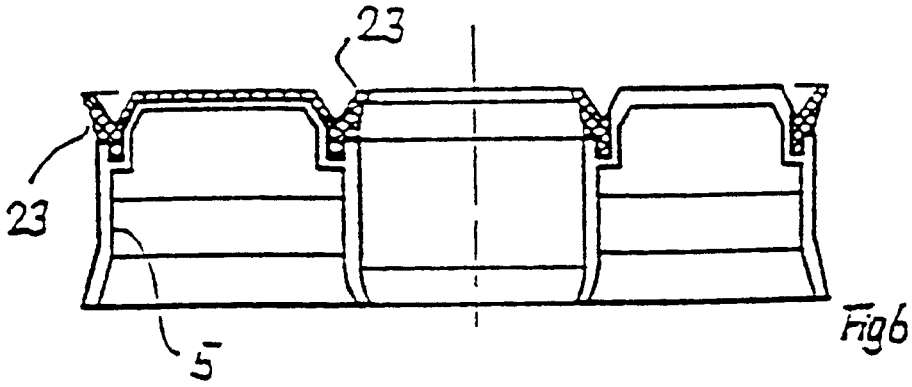
FIG. 6 is a cross-sectional view taken along the line VI—VI of FIG. 5.
Figure 5:
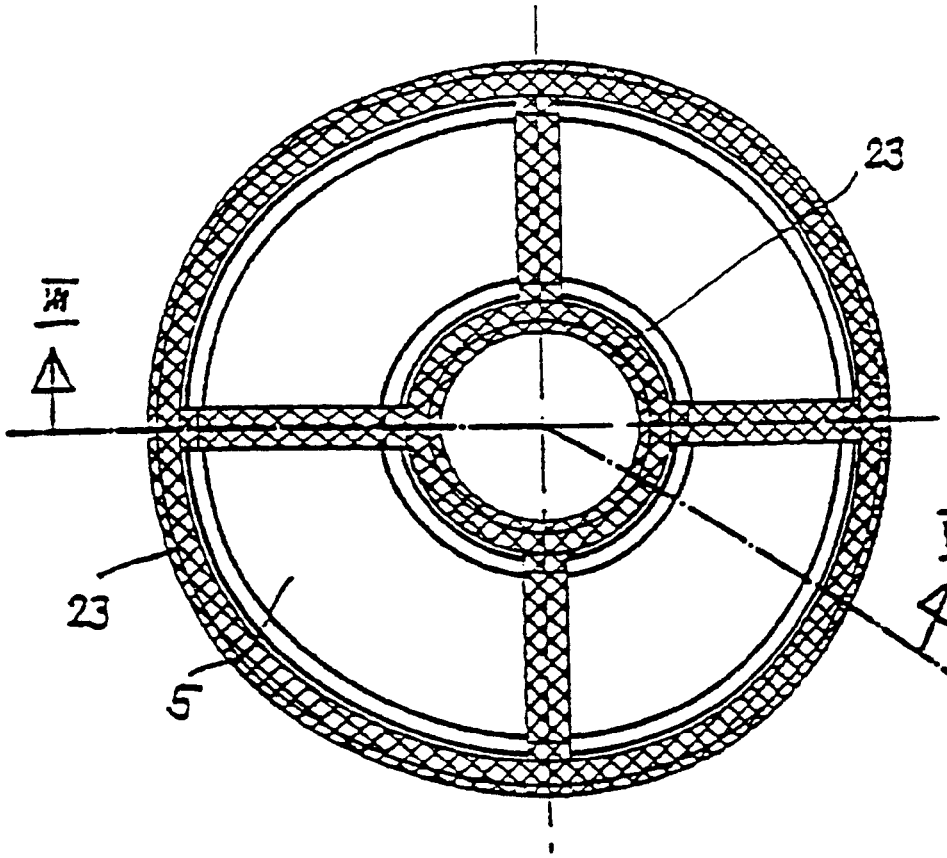
FIG. 5 is a top view of the annular piston used in the cartridge.

When the material in the chambers 1, 2 contains volutile plastic parts, as for example styrene, it is necessary that the pistons 4 or 5 are resistant to exposure to such substances. The pistons are therefore, as this is shown in FIGS. 5 and 6, manufactured of polyamide. Since this material, however, is too hard for construction of packing washers, the washers are constructed out of a low-density polyethylene. During manufacture, first the actual piston 4 or 5 is manufactured via injection molding out of a polyamide. The packing washers 23 are molded out of LDPE during a subsequent second course of manufacture.

What is claimed is:

1. An ejection device for a cartridge containing two components, wherein the cartridge has an inner chamber and an outer chamber concentric thereto, the inner and outer chambers being open at a backside and having an outlet at an end remote from the backside, wherein pistons close off the backsides of the chambers and are configured to move in the chambers along a longitudinal axis thereof, wherein a cap is mountable on the backside of the chambers, the cap having a tapped hole therein and a plurality of bores separate from the tapped hole, wherein a center ejection slide is provided and is coaxial with respect to the longitudinal axis of the chambers, the ejection slide including a threaded spindle configured to threadedly engage the tapped hole in the cap and move axially with respect to the cap in response to rotation thereof, the threaded spindle being rotatably supported in the tapped hole and having an abutment at one end to abut the piston of the inner chamber and having a top plate relatively, rotatably supported at an other end thereof, the top plate being configured to move axially with the threaded spindle, wherein several pressure rods are distributed about a circumference of the top plate, each of the pressure rods being guided through the bores of the cap, being out of contact with an annular wall of the cartridge separating the inner and outer chambers, and each having an abutment to abut the piston of the outer chamber, whereby axial movement of the pistons along the longitudinal axis of the chambers moves the components toward the outlet.

2. The ejection device according to claim 1, wherein the pressure rods are integral with the top plate.

3. The ejection device according to claim 1, wherein a sleeve projects above the cap and is integral therewith and plural reinforcing ribs extend from an edge of the cap to the sleeve, and wherein the tapped hole is arranged in the sleeve.

4. The ejection device according to claim 1, wherein the several pressure rods include three pressure rods offset at 120° with respect to one another.

5. The ejection device according to claim 1, wherein the top plate includes a sleeve integral therewith and plural reinforcing ribs extend from an edge of the top plate to the sleeve, and wherein the threaded spindle is supported in a bore arranged in the sleeve.

6. The ejection device according to claim 1, wherein the cap and the backside of the cartridge are connected with one another through bayonet locks, so the cap is prevented from axial movement with respect to the cartridge.

7. The ejection device according to claim 1, wherein the pressure rods are connected by a common annular abutment.

8. The ejection device according to claim 1, wherein the pistons consist of polyamide and corresponding packing washers consist of a low-density polyethylene, whereby the packing washers are injected onto the piston via injection molding.

9. The ejection device according to claim 1, wherein the pressure rods are oriented parallel with the threaded spindle.

10. An ejection device for a cartridge containing two components, wherein the cartridge contains an inner chamber and an outer chamber concentric thereto, the inner and outer chambers being open at a backside and having an outlet at an end remote from the backside, wherein pistons close off the backsides of the chambers and are configured to move in the chambers along a longitudinal axis thereof, wherein a cap is mountable on the backside of the chambers, the cap having a tapped hole therein and a plurality of bores separate from the tapped hole, wherein a center ejection slide is provided and is coaxial with respect to the longitudinal axis of the chambers, the ejection slide including a threaded spindle configured to threadedly engage the tapped hole in the cap, and having an abutment at one end to abut the piston of the inner chamber and having a top plate relatively, rotatably supported at an other end thereof, the top plate being configured to move axially with the threaded spindle, wherein three pressure rods are provided and are offset 120° with respect to one another, the pressure rods being arranged at a radial distance with respect to the center ejection slide, each of the pressure rods having an abutment at one end to abut the piston of the outer chamber, wherein the threaded spindle is rotatably supported in the top plate, wherein a sleeve projects above the cap and is integral therewith and plural reinforcing ribs extend from an edge of the cap to the sleeve and wherein the pressure rods extend from the top plate and are guided in the bores of the cap, and wherein the tapped hole is arranged in the sleeve.

11. The ejection device according to claim 10, wherein the cap and the backside of the cartridge are connected with one another through at least one of bayonet locks and a thread.

12. An ejection device for a cartridge containing two components, wherein the cartridge contains an inner chamber and an outer chamber concentric thereto, the inner and outer chambers being open at a backside and having an outlet at an end remote from the backside, and wherein pistons close off the backsides of the chambers and are configured to move in the chambers along a longitudinal axis thereof, wherein a cap is mountable on the backside of the chambers, the cap having a tapped hole therein and a plurality of bores separate from the tapped hole, wherein a center ejection slide is provided and is coaxial with respect to the longitudinal axis of the chambers, the ejection slide including a threaded spindle configured to threadedly engage the tapped hole in the cap, and having an abutment at one end to abut the piston of the inner chamber and having a top plate relatively, rotatably supported at an other end thereof, the top plate being configured to move axially with the threaded spindle, wherein three pressure rods are provided and are offset 120° with respect to one another, the pressure rods being arranged at a radial distance with respect to the center ejection slide, each of the pressure rods having an abutment at one end to abut the piston of the outer chamber, wherein the threaded spindle is rotatably supported in the top plate, wherein the top plate includes a sleeve integral therewith and plural reinforcing ribs extend from an edge of the top plate to the sleeve and wherein the pressure rods extend from the top plate and are guided in the bores of the cap, and wherein the threaded spindle is supported in a bore of the top plate, the bore of the top plate being arranged in the sleeve.

13. The ejection device according to claim 12, wherein the cap and the backside of the cartridge are connected with one another through at least one of bayonet locks and a thread.

* * * * *